United States Patent [19]

Ishibashi et al.

[11] Patent Number: 4,612,893

[45] Date of Patent: Sep. 23, 1986

[54] FUEL INJECTION VALVE

[75] Inventors: Toru Ishibashi; Shigeo Taira, both of Higashimatsuyama, Japan

[73] Assignee: Diesel Kiki Co., Ltd., Tokyo, Japan

[21] Appl. No.: 796,414

[22] Filed: Nov. 8, 1985

[30] Foreign Application Priority Data

Nov. 14, 1984 [JP] Japan ..... 59-238290

[51] Int. Cl.[4] ..... F02B 3/00

[52] U.S. Cl. ..... 123/447; 123/506; 123/496

[58] Field of Search ..... 123/446, 447, 467, 506, 123/496, 459

[56] References Cited

U.S. PATENT DOCUMENTS

| | | | |
|---|---|---|---|
| 4,437,443 | 3/1984 | Hofbauer | 123/446 |
| 4,448,168 | 5/1984 | Komada | 123/447 |
| 4,459,959 | 7/1984 | Terada | 123/446 |
| 4,505,244 | 3/1985 | Smith | 123/447 |
| 4,513,719 | 4/1985 | Edo | 123/447 |

*Primary Examiner*—Ronald B. Cox

*Attorney, Agent, or Firm*—Frishauf, Holtz, Goodman & Woodward

[57] ABSTRACT

A fuel injection valve for an internal combustion engine, in which a lift-limiting plunger is slidably fitted in a plunger chamber to receive fuel pressure for limiting the lifting amount of a nozzle needle. A back pressure chamber is defined by an end face of the plunger remote from the nozzle needle as part of the plunger chamber. A selector valve is controlled by an electronic control unit to establish communication between the back pressure chamber and a fuel intake passageway during low speed/low load operation of the engine, whereby the nozzle needle is lifted through a limited stroke to obtain a reduced fuel injection rate as well as a prolonged fuel injection period. A pressure inlet chamber permanently communicates with the back pressure chamber and is selectively communicated with the fuel intake passageway and disconnected therefrom by the selector valve, in synchronism with selective establishment and interruption of communication between the back pressure chamber and the fuel intake passageway. An accumulator is slidably fitted within an accumulator chamber communicating with the pressure inlet chamber and liftable in a direction away from the pressure inlet chamber against the force of a return spring with an increase in the pressure within the latter chamber. Thus, a reduction in the fuel injection quantity caused by the limitation of the needle lift can be compensated for.

2 Claims, 1 Drawing Figure

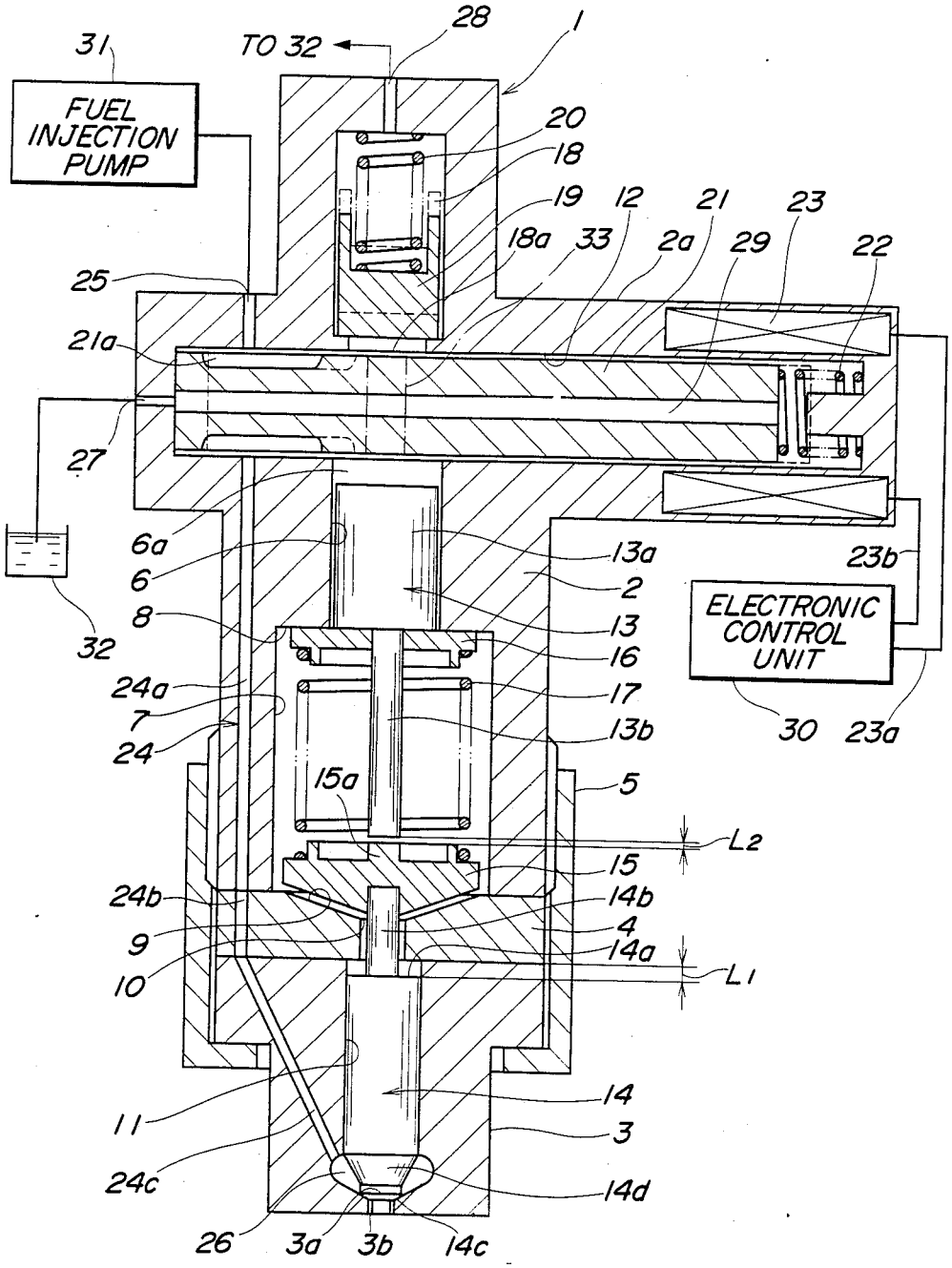
FUEL INJECTION PUMP
TO 32
ELECTRONIC CONTROL UNIT
31
28
1
20
18
19
12
21
23
18a
33
2a
29
22
25
21a
27
6a
6
8
32
24a
7
24
13a
2
13
16
17
13b
23b
30
23a
15a
5
L2
15
24b
14b
9
4
14a
10
L1
11
14
3
24c
14d
26
3a
3b
14c

FUEL INJECTION VALVE

BACKGROUND OF THE INVENTION

This invention relates to a fuel injection valve for use in internal combustion engines, and more particularly to a fuel injection valve of this kind which has a reduced nozzle needle lift during low speed/low load operation of the engine such as idling.

A diesel engine in general is provided with fuel injection valves with their nozzle tips projected into respective cylinders of the engine to inject fuel delivered from a fuel injection pump into the respective cylinders in an intermittent manner. Conventionally, automatic injection valves are employed in most diesel engines, which are constructed such that when the pressure of pressurized fuel delivered from a fuel injection pump surpasses the setting load of a nozzle spring urging a nozzle needle in its closing diretion, the nozzle needle is lifted by the pressurized fuel so that the fuel is injected into an engine cylinder.

However, according to such conventional construction, it is difficult to control both the fuel injection rate and the fuel injection period to respective different values according to operating conditions of the engine, particularly, between during low speed/low load operation of the engine such as idling and during normal operation of same. Further, in the conventional automatic injection valves, the nozzle needle is lifted through a constant stroke over all operating conditions of the engine. As a result, the conventional construction has the disadvantage that during low speed/low load operation of the engine such as idling fuel injection takes place over a very short period of time and at a high injection rate, causes large combustion noise in the engine.

To overcome this disadvantage, a fuel injection valve has been proposed, e.g. by Japanese Provisional Utility Model Publication No. 59-62273, which comprises a main body having injection holes formed in its tip and a fuel intake passageway formed therein and communicating with the injection holes, a nozzle needle slidably fitted within the main body for alternately closing and opening the injection holes, a lift-limiting plunger slidably fitted in a plunger chamber defined within the main body and having an end face remote from the nozzle needle disposed as a pressure-receiving surface to receive fuel pressure for limiting the lifting amount of the nozzle needle, and a selector valve disposed to selectively establish or interrupt communication between a back pressure chamber defined by the end face of the plunger remote from the nozzle needle as part of the plunger chamber and the above-mentioned fuel intake passageway. During low speed/low load operation of the engine, the selector valve is controlled to establish communication between the back pressure chamber and the fuel intake passageway, whereby the the nozzle needle is lifted through a limited or reduced stroke to obtain a reduced fuel injection rate as well as a prolonged fuel injection period.

According to this proposed fuel injection valve, by virtue of the limited lifting stroke of the nozzle needle the opening area of the injection holes is kept at a moderate small value to obtain a reduced injection quantity, that is, a lower fuel injection rate and a longer injection period, even when the pressurized fuel from the fuel injection pump has high pressure, thereby mitigating engine combustion noise during low speed/low load operation of the engine such as idling.

However, according to the proposed fuel injection valve, if during needle lift-limited operation a pumping plunger of the fuel injection pump is operated through the same effective delivery stroke as that executed by a plunger of a conventional ordinary type fuel injection valve incapable of limiting the lifting amount of the nozzle needle, the actual quantity of fuel injected into the engine cylinder decreases by an amount corresponding to the amount of throttling the injection holes by the limited stroke of the nozzle needle, resulting in reduced engine output.

One way to prevent such engine output reduction would be to set a control sleeve of the fuel injection pump to a position where the effective delivery stroke of the nozzle needle is increased during needle lift-limited operation so as to compensate for a reduction in the fuel injection quantity caused by limiting the lifting amount. However, this requires returning the control sleeve to a normal position when the engine enters a normal operating region, which in turn requires a complicate control mechanism as well as a complicate manner of operating the mechanism. Besides, it is also difficult to smoothly change the effective delivery stroke of the pumping plunger at changeover from needle lift-limited operation to needle lift-unlimited operation or vice versa.

SUMMARY OF THE INVENTION

It is the object of the invention to provide a fuel injection valve which is capable of reducing combusion noise of the engine during low speed/low load operation and which is provided with a means of simple construction for compensating for a reduction in the fuel injection quantity caused by limiting the nozzle needle lift without changing the effective delivery stroke of the pumping plunger of the fuel injection pump.

The present invention provides a fuel injection valve for an internal combustion engine, which comprises a main body having injection holes formed in its tip and a fuel intake passageway formed therein and communicating with the injection holes, a nozzle needle slidably fitted within the main body for alternately closing and opening the injection holes, a lift-limiting plunger slidably fitted in a plunger chamber defined within the main body and having an end face remote from the nozzle needle disposed as a pressure-receiving surface to receive fuel pressure for limiting the lifting amount of the nozzle needle, a selector valve disposed to selectively establish or interrupt communication between a back pressure chamber defined by the end face of the plunger remote from the nozzle needle as part of the plunger chamber and the above-mentioned fuel intake passageway, and control means for controlling the selector valve in dependence on operating conditions of the engine. When the engine is operating in a predetermined low speed/low load condition such as idling, the selector valve is controlled by the control means to establish communication between the back pressure chamber and the fuel intake passageway, whereby the the nozzle needle is lifted through a limited or reduced stroke to obtain a reduced fuel injection rate as well as a prolonged fuel injection period.

The fuel injection valve according to the invention is characterized by comprising: a pressure inlet chamber permanently communicating with the back pressure chamber and disposed to be selectively communicated with the fuel intake passageway and disconnected therefrom by the selector valve, in synchronism with the selective establishment and interruption of communication between the back pressure chamber and the fuel intake passageway; an accumulator chamber communicating with the pressure inlet chamber; an accumulator slidably fitted within the accumulator chamber and liftable in a direction away from the pressure inlet chamber with an increase in the pressure within the pressure inlet chamber; and urging means urging the accumulator in a direction toward the pressure inlet chamber against lifting of the accumulator.

The above and other objects, features and advantages of the invention will be more apparent from the ensuing detailed description taken in conjunction with the accompanying drawing.

BRIEF DESCRIPTION OF THE DRAWING

The single figure shows a fuel injection valve according to an embodiment of the invention.

DETAILED DESCRIPTION

The invention will now be described in detail with reference to the drawing showing an embodiment thereof. In the figure, reference numeral 1 designates a fuel injection nozzle, on a lower end of which is mounted a nozzle body 3 and fastened thereto by means of a retaining nut 5 threadedly fitted on the nozzle 1, via a distance piece 4. The nozzle holder 2 is formed therein with a plunger chamber 6 and an enlarged spring chamber 7, both extending along the axis of the nozzle holder 2 and continous with each other with an annular stepped shoulder 8 therebetween. A lower end of the spring chamber 7 opens in a lower end face of the nozzle holder 2 in alignment with an upper open end of a tapered hole 9 having a lower side smaller in diameter than an upper side thereof and having a lower open end in alignment, via a small axial hole 10, with an upper open end of a needle guide bore 11 formed in the nozzle body 3. The nozzle holder 2 has an enlarged head portion **2*a* at an upper portion thereof, which is formed therein with a transversely extending valve chamber 12. An upper open end of the plunger chamber 6 opens into the valve chamber 12 at an axially intermediate portion thereof at right angles thereto in a fashion forming a T-shaped intersection together with the chamber 12. A lift-limiting plunger 13, which is a so-called "central plunger", has an enlarged portion 13*a* slidably fitted within the plunger chamber 6, for limiting the lifting amount of a nozzle needle 14, hereinafter referred to. The enlarged portion 13*a* of the plunger 13 extends upwardly from an axially intermediate portion of the plunger, from lower end face of which downwardly extends a reduced-diameter portion 13*b* into the spring chamber 7. The nozzle needle 14 is slidably fitted in the needle guide bore 11 formed in the nozzle body 3, and has an upper end face 14*a* provided with an upwardly extending reduced-diameter journal 14*b* supporting thereon a movable spring seat 15. A nozzle spring 17 formed of a coiled spring is interposed tautly between the movable spring seat 15 and a stationary spring seat 16 affixed to an upper end wall of the spring chamber 7 defining the stepped shoulder 8. The nozzle needle 14 is disposed to be biased in a lower extreme or seated position by the nozzle spring 17, with its valve seating portion 14*c* seated on a valve seat 3*a* formed in the nozzle body 3, thus keeping the injection holes 3*b* closed, when no injection is effected. In this needle-seated position, a whole lifting gap Ll is provided between the upper end face 14*a* of the nozzle needle 14 and a lower end face of the distance piece 4. On the other hand, the lift-limiting plunger 13 is biased in a lower extreme position due to its own gravity, wherein an initial lifting gap L2 is provided between a lower end face of the reduced-diameter portion 13*b* and an opposed upper end face of a central projection 15*a* on an upper end face of the movable spring seat 15**.

A back pressure chamber **6*a* is defined in an upper end portion of the plunger chamber 6 between an upper end face of the lift-limiting plunger 13 and a border plane between the plunger chamber 6 and the valve chamber 12. An accumulator chamber 18 is defined in the nozzle holder 2 and disposed opposite the back pressure chamber 6*a* with respect to the valve chamber 12 interposed therebetween, and has its lower open end opening into an axially intermediate portion of the valve chamber 12 at right angles thereto in a fashion forming a T-shaped inter-section together with the chamber 12. An accumulator 19, in the form of a piston, is slidably fitted in the accumulator chamber 18 and urged downward by a return spring 20 formed of a coiled spring accommodated in the chamber 18. As described later, the accumulator 19 acts to compensate for a reduction in the fuel injection quantity caused by limiting the lifting amount of the nozzle needle 14. A pressure inlet chamber 18*a* forming part of the chamber 18 is defined between a lower end face of the accumulator 19 and a border plane between the accumulator chamber 18 and the valve chamber 12 and in permanent communication with the back pressure chamber 6*a* by way of a communication passage 33 formed in the nozzle holder 2 along an inner peripheral surface of the valve chamber 12, indicated by the chain line in the figure. The pressure inlet chamber 18*a* is disposed in axial alignment with the back pressure chamber 6*a*. A selector valve 21 formed of a spool valve is slidably fitted within the valve chamber 12 for movement through a predetermined stroke. The selector valve 21 has an annular groove 21*a* formed in its outer peripheral surface near its one end and at a location registrable with a fuel intake passageway formed by a fuel intake passage 24 and a fuel inlet port 25, both hereinafter referred to. The valve 21 is urgedly biased by a return spring 22 formed of a coiled spring arranged at the opposite end, to a left extreme position as indicated by the solid lines in the figure, wherein the back pressure chamber 6*a* and the accumulator chamber 18 are disconnected from the fuel intake passageway 24, 25 by the selector valve 21, while when the selector valve 21 is in the opposite right extreme position as indicated by the broken lines, the back pressure chamber 6*a* and the accumulator chamber 18 are both communicated with the fuel intake passage 24 by way of the annular groove 21*a*. The selector valve 21 is selectively shifted between the above two extreme positions, by a solenoid 23 arranged around the opposite end of the selector valve 21 and electrically connected to an electronic control unit 30 by lead wires 23*a* and 23*b*. The control unit 30 is responsive to operating conditions of the engine, not shown, and supplies a driving signal to the solenoid 23 when the engine is operating in a predetermined low speed/low load region such as an idling region, to energize the solenoid 23 so that the selector valve 21 is shifted to the right extreme position against the force of the return spring 22. On the other hand, when the engine is operating in a normal operating region other than the predetermined low speed/low load region, the control unit 30 deenergizes the solenoid 23 to allow the selector valve 21 to be returned to the left extreme position by the force of the return spring 22**.

The fuel intake passage 24 communicates between the fuel inlet port 25 formed in an upper surface of the nozzle holder 2 and a pressure chamber 26 defined within the nozzle body 3, and is formed of a first through hole 24*a* formed in the nozzle holder 2, a second through hole 24*b* formed in the distance piece 43, and a third through hole 24*c* formed in the nozzle body 3. The first through hole 24*a* has its upper end so located as to permanently communicate with the fuel inlet port 25 via the annular groove 21*a* in the selector valve 21 both when the selector valve 21 assumes the left extreme position and when it assumes the right extreme position. The fuel inlet port 25 is to be connected to a discharge port of a fuel injection pump 31. The nozzle needle 14 has its pressure-receiving surface 14*d* located within the pressure chamber 26 formed in the nozzle body 3.

In the figure, reference numerals 27 and 28 designate drain ports to be connected to a fuel tank 32 or a like lower pressure zone for returning leak fuel thereto from the valve chamber 12 and the accumulator chamber 18, respectively, and 29 a leak fuel passage formed along the axis of the spool 21.

The operation of the fuel injection valve according to the invention will now be described.

When the engine is operating in the predetermined low speed/low load region, the control unit 30 causes the solenoid 23 to be energized to force the selector valve 21 to be moved to the right extreme position against the force of the return spring 22 as indicated by the broken lines so that the back pressure chamber 6*a* and the pressure inlet chamber 18*a* of the accumulator chamber 18 are communicated with the fuel intake passageway 24, 25 via the annular groove 21*a* of the selector valve 21. In this position, pressurized fuel from the fuel injection pump 31 is guided through the fuel inlet port 25 and then along the annular groove 21*a* of the selector valve 21, part of which fuel flows into the back pressure chamber 6*a* and the pressure inlet chamber 18*a* whereby the lift-limiting plunger 13 is downwardly urged by the pressurized fuel in the chamber 6*a* to thereby restrict the lifting amount of the nozzle needle 14, and the accumulator 19 is urgedly displaced upward against the force of the return spring 20 into a position as indicated by the broken lines in the figure.

On the other hand, the remainder of the pressurized fuel delivered to the annular groove 21*a* is further guided through the fuel intake passage 24, i.e. the first through third passages 24*a*–24*c* into the pressure chamber 26. When the pressure within the pressure chamber 26 thus rises to a predetermined initial valve opening pressure, the nozzle needle 14 is lifted through the initial lift L2 so that the injection holes 3*b* are opened to a substantially small opening to cause fuel injection through the injection holes 3*b*. On this occasion, even if the pressure within the pressure chamber 26, i.e. the pressure of pressurized fuel from the fuel injection pump exceeds the initial valve opening pressure, the nozzle needle 14 is prevented from further lifting beyond the initial lift L2 since the fuel pressure within the back pressure chamber 6*a* downwardly urges the lift-limiting plunger 13 at its upper end face, thereby maintaining the opening area of the injection holes 3*b* at the substantially small value. Thus, the fuel injection rate is maintained at a low value and the fuel injection period is made longer.

When the pressure delivery of fuel by the fuel pumping plunger of the fuel injection pump 31 terminates, the supply of fuel to the fuel inlet port 25 is accordingly interrupted. However, even then the fuel pressure within the pressure inlet chamber 18*a* is transmitted to the pressure chamber 26 through the annular groove 21*a* and the fuel intake passage 24 to act upon the chamber 26, whereby the nozzle needle 14 is held open to cause continued injection of fuel from the pressure inlet chamber 18*a* through the injection holes 3*b*, to thereby compensate for a reduction in the fuel injection quantity caused by limitation of the lifting amount of the nozzle needle 14.

After the injection of fuel from the pressure inlet chamber 18*a* has been completed, the accumulator 19 is returned by the force of the return spring 20 to the original position as indicated by the solid lines, and at the same time the nozzle needle 14 is downwardly forced by the force of the nozzle spring 17 to the position where the nozzle needle has its valve seat 14*c* seated on the valve seat 3*a* to close the injection holes 3*b*.

On the other hand, when the engine is operating in a normal operating region other than the predetermined low speed/low load operating region, the control unit 30 deenergizes the solenoid 23 to allow the selector valve 21 to be moved to and held at the left extreme position as indicated by the solid lines in the figure by the force of the return spring 22, whereby the back pressure chamber 6*a* and the pressure inlet chamber 18*a* of the accumulator chamber 18 are both disconnected from the fuel intake passageway 24, 25 so that neither of the lift-limiting plunger 13 nor the accumulator 19 is acted upon by fuel pressure to bring about a lift limitation-released state. Consequently, all the pressurized fuel from the fuel injection pump 31 is guided through the fuel inlet port 25, annular groove 21*a*, and fuel intake passage 24 into the pressure chamber 26. When the pressure within the pressure chamber 26 reaches the predetermined initial valve opening pressure, the nozzle needle 14 is lifted against the force of the nozzle spring 17 to execute the initial lift L2 whereby the injection holes 3*b* are opened to a substantially small opening. With a further increase in the pressure within the pressure chamber 26, the nozzle needle 14 is further lifted together with the lift-limiting plunger 13 against the force of the nozzle spring 17 to execute the whole lift Ll whereby the injection holes 3*b* are opened to the maximum opening to obtain a high fuel injection rate and a short fuel injection period.

When the lift-limiting plunger 13 has been lifted as noted above, the residual fuel within the back pressure chamber 6*a* flows into the pressure inlet chamber 18*a* to forcibly displace the accumulator 19 upward stroke against the force of the spring 20. Therefore, in this high fuel injection rate mode, the fuel injection is effected in two steps such that the nozzle needle 14 is lifted through the initial lift L2 against the force of the nozzle spring 17, and then further lifted until the whole lift Ll is executed, against the combined force of the nozzle spring 17 and the return spring 20.

After completion of the fuel injection, termination of the pressure delivery of the pumping plunger of the fuel injection pump causes interruption of fuel supply to the fuel inlet port 25, lowering the pressure within the pressure chamber 26 so that the lift-limiting plunger 13 and the nozzle needle 14 descend, respectively, by its own gravity and by the force of the nozzle spring 17, to thereby close the injection holes 3*b*.

Although in the embodiment described above the selector valve 21 is driven by the solenoid 23, this is not limitative, but a selector valve responsive to delivery fuel pressure from the fuel injection pump may be employed instead. Further alternatively may be employed a selector valve responsive to load on the engine or rotation of the engine.

What is claimed is:

1. In a fuel injection valve for an internal combustion engine, including a main body having injection holes formed in a tip thereof and a fuel intake passageway formed therein and communicating with said injection holes, a nozzle needle slidably fitted within said main body for alternately closing and opening said injection holes, a plunger chamber defined within said main body, a lift-limiting plunger slidably fitted in said plunger chamber and having an end face remote from said nozzle needle disposed as a pressure-receiving surface to receive fuel pressure for limiting the lifting amount of said nozzle needle, a back pressure chamber defined by said end face of said plunger remote from said nozzle needle as part of said plunger chamber, a selector valve disposed to selectively establish or interrupt communication between said back pressure chamber and said fuel intake passageway, and control means for controlling said selector valve in dependence on operating conditions of said engine, wherein when said engine is operating in a predetermined low speed/low load condition, said selector valve is controlled by said control means to establish communication between said back pressure chamber and said fuel intake passageway, whereby said nozzle needle is lifted through a limited stroke to obtain a reduced fuel injection rate as well as a prolonged fuel injection period, the improvement comprising: a pressure inlet chamber permanently communicating with said back pressure chamber and disposed to be selectively communicated with said fuel intake passageway and disconnected therefrom by said selector valve, in synchronism with said selective establishment and interruption of communication between said back pressure chamber and said fuel intake passageway; an accumulator chamber communicating with said pressure inlet chamber; an accumulator slidably fitted within said accumulator chamber and liftable in a direction away from said pressure inlet chamber with an increase in the pressure within said pressure inlet chamber; and urging means urging said accumulator in a direction toward said pressure inlet chamber against lifting of said accumulator.

2. The fuel injection valve as claimed in claim 1, including a valve chamber formed in said main body and extending transversely thereof, said selector valve comprising a spool valve slidably fitted within said valve chamber, said spool valve having an outer peripheral surface thereof formed with an annular groove at a location registrable with said fuel intake passageway, said fuel intake passageway opening into said valve chamber at a location registrable with said annular groove, said back pressure chamber and said pressure inlet chamber opening into said valve chamber in axial alignment with each other and at a location registrable with said annular groove, said spool valve being adapted to selectively assume a first position where said annular groove communicates said fuel intake passageway with said back pressure chamber and said pressure inlet chamber, and a second position where said fuel intake passageway is disconnected from said back pressure chamber and said pressure inlet chamber.

* * * * *